US005138773A

United States Patent [19]

Goodwin et al.

[11] Patent Number: 5,138,773

[45] Date of Patent: Aug. 18, 1992

[54] DRYING KILN FOR LUMBER HAVING INSULATION

[75] Inventors: Thomas E. Goodwin, Orange Park, Fla.; Gary W. Hogue, West Linn, Oreg.

[73] Assignee: U.S. Natural Resources, Inc., Vancouver, Wash.

[21] Appl. No.: 622,746

[22] Filed: Dec. 5, 1990

[51] Int. Cl.[5] ..... F26B 7/00

[52] U.S. Cl. ..... 34/13.8; 34/201; 34/16.5; 432/248; 52/408

[58] Field of Search ..... 34/201, 191, 13.8, 16.5, 34/202, 218; 110/180; 432/248, 26, 198; 126/273.5; 52/408

[56] References Cited

U.S. PATENT DOCUMENTS 3,932,946 1/1976 Johnson ..... 34/201
4,233,752 11/1980 Kleinguenther ..... 34/16.5
4,376,342 3/1983 Gavioli ..... 34/201
4,653,202 3/1987 More-Chevalier ..... 34/201
4,774,773 10/1988 Zwyssig ..... 34/201

*Primary Examiner*—Henry A. Bennet
*Assistant Examiner*—Denise L. F. Gromada
*Attorney, Agent, or Firm*—Robert L. Harrington

[57] ABSTRACT

A kiln for the drying of lumber utilizing panels attached to the kiln structure. The attached panels form the interior surface and the exterior surface of the kiln. The panels have a cavity for the placement of insulating material. The insulating material is encapsulated in a liquid impervious container thus preventing condensates from infiltrating the insulating material. The isolation of the insulating material from the ambient moist air of the kiln maintains the insulating quality of the insulation normally lost due to exposure to moisture laden air and also aids in preventing the corrosive effect of moist insulation in contact with the metal surfaces.

9 Claims, 2 Drawing Sheets

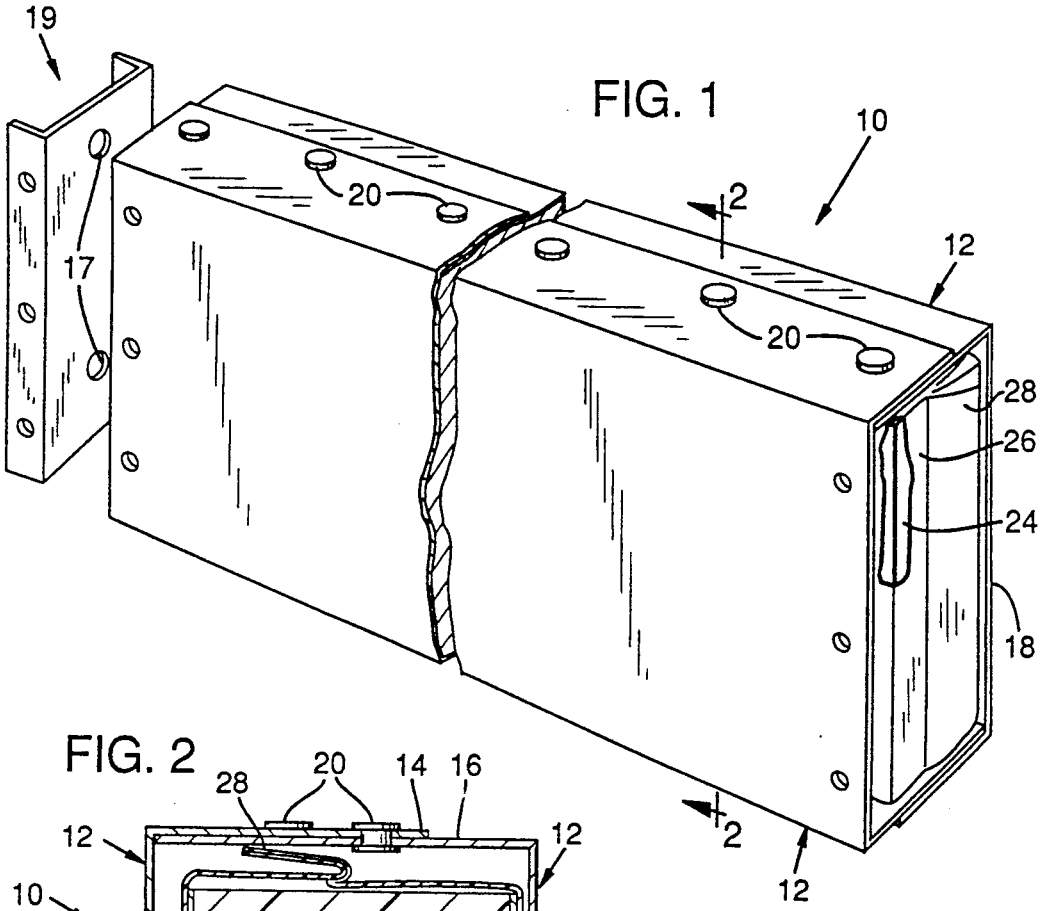
FIG. 1
FIG. 2
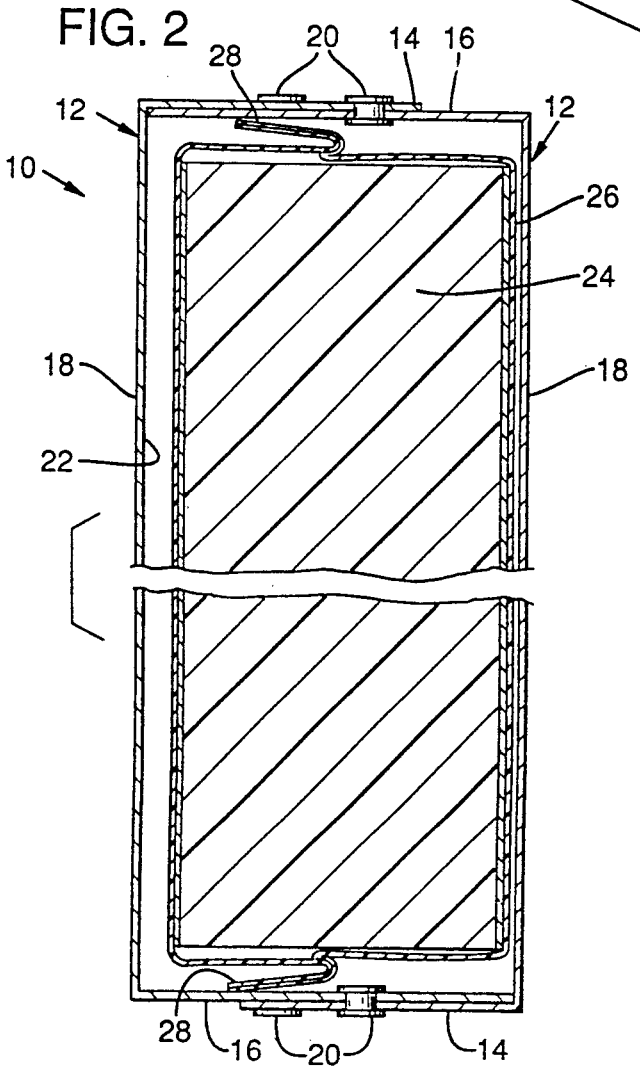

DRYING KILN FOR LUMBER HAVING INSULATION

BACKGROUND INFORMATION

1. Field of the Invention

This invention relates to drying kilns having improved insulation and more particularly to protection for the insulation to inhibit the deteriorating effects of the insulation being exposed to moisture.

2. Background of the Invention

Drying kilns are utilized to reduce the moisture content of lumber products that have been sawed from logs. The kilns generally are large buildings that have the capacity of handling thousands of board feet of lumber at a time. A conveying system, such as a fork lift truck, is provided to transport the lumber into and out of the kiln via an entryway. Most often the lumber is stacked in a layered configuration so that each lumber piece has each of its surfaces exposed to the surrounding air. Each layer of the lumber pieces is separated from each other by furring or spacer strips strategically placed along the lumber length so that warpage is minimized. In addition to the conveying system the kiln will have a heating system for heating air, a circulating system for circulating the heated air around and through the lumber and an exhaust system for exhausting the moisture laden air out of the kiln. The kiln is set up to circulate air through the stacked lumber with a continuous flow of heated dry air going into the kiln and warm moist air coming out of the kiln. The circulating of the heated dry air through the layers of lumber reduces the moisture content of the lumber.

Control of the temperature as well as minimizing the energy costs is important and consequently the insulation provided in the building walls and ceiling (roof) must be highly effective in preventing heat from being transferred through the walls.

Previously the insulation provided was not reliable over an extended period of time. The heavily moisture laden air would penetrate through the inner walls and moisture would condense to contaminate the insulation. The R value of the insulation dramatically dropped as the insulation absorbed moisture. Furthermore, most such inner walls are metal and the wet insulation abutting the metal (e.g. aluminum) walls accelerated corrosion. Typically, the drying kilns had to be refurbished on a frequent basis at a huge cost to the lumber mill.

BRIEF SUMMARY OF THE INVENTION

The present invention addresses the problem of moisture infiltrating the insulating material utilized in the modern drying kilns. The modern kiln is constructed of a metal framework onto which fabricated metal panels having a cavity for insulating material are attached to form the enclosure of the structure. The panels are typically on the order of four foot width by 25 foot lengths and have an outer skin and an inner skin in a spaced relation determined by the desired thickness of the insulating material. The insulating material placed within the cavity of the panel is encapsulated in a sealed container that prevents the moisture laden air of the kiln from contacting and condensing on and in the insulation. The sealing of the insulation from the ambient air that is present or has infiltrated into the cavity of the panel thus maintains the insulating value of the insulation and prevents the corroding effect of either the foil face of the insulation or the inner surface of the panels.

Other objects and advantages of the present invention will be realized from the description of the preferred embodiment read in conjunction with the drawings.

BRIEF DESCRIPTION OF THE DRAWINGS

FIG. 1 is a view of a panel containing an insulating material encapsulated in a liquid impervious container according to the present invention;

FIG. 2 is a view of the panel of FIG. 1 as viewed on view lines 2—2 of FIG. 1;

DESCRIPTION OF THE PREFERRED EMBODIMENT

Figure 5:
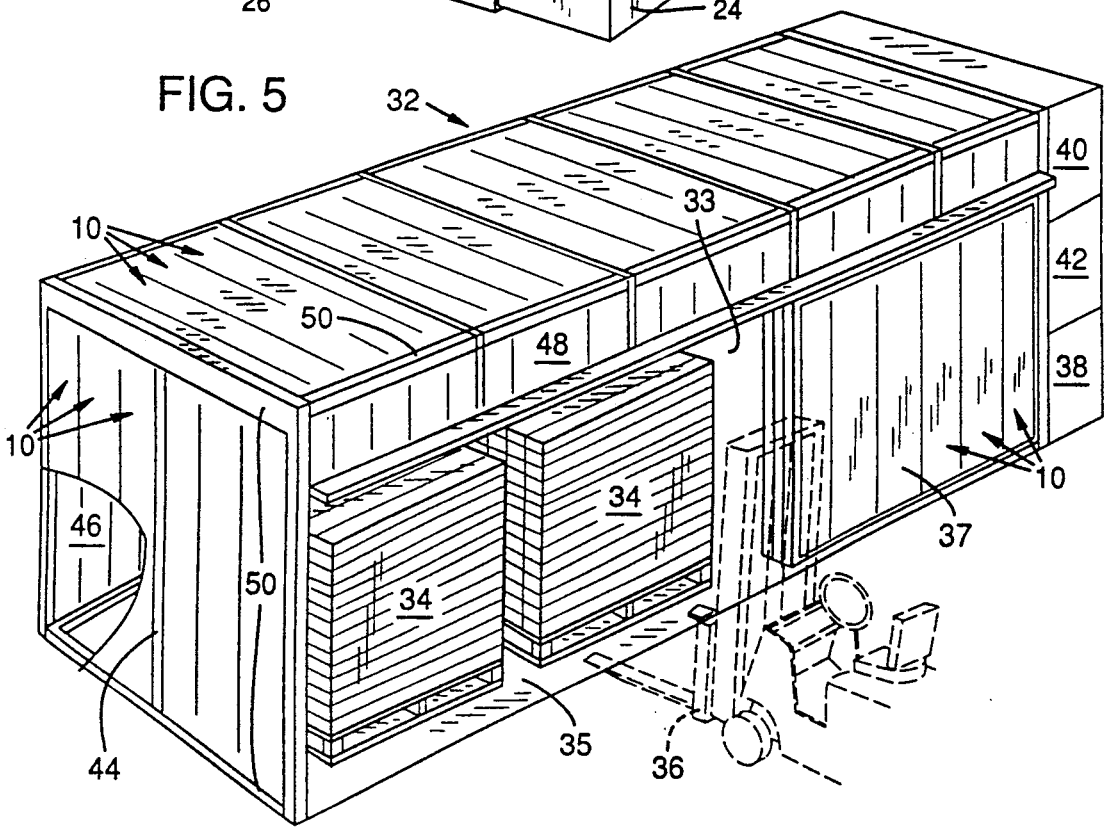
FIG. 5 is a diagrammatical representation of a drying kiln.

The preferred embodiment of the present invention is illustrated in FIG. 5. A member 10 (also referred to as a panel) is attachable to the framework of a drying kiln using conventional techniques well know in the construction trade. The member 10 when attached to the framework of the kiln provides both an interior wall surface 46 and an exterior wall surface 48 of the kiln. The panel 10 has encapsulated insulating material contained within its cavity to provide an insulating barrier for the kiln enclosure.

A panel 10 as incorporated into the drying kiln of FIG. 5 is illustrated in detail in FIGS. 1 and 2. The panel 10 is fabricated by assembling two "U" shaped members 12 as illustrated. The "U" shaped members 12 have legs 14 and 16 and a connecting web 18. The "U" shaped members 12 are joined together with the leg 14 of one member overlapping the leg 16 of the other member as illustrated in the figures. The overlapping legs 14, 16 are fastened together by suitable fasteners 20 such as by riveting. As shown, the assembly of two "U" shaped members 12 forms the panel 10 having an interior cavity 22 that is rectangular in cross section and is of a dimension to receive an insulating material 24. End caps 19 are provided to close each end of the panel 10 formed by the assembly of the members 12. Weep holes 17 are provided in the end cap 19 so that any accumulated liquid may drain out of the panel 10. The end caps are fastened to the panel 10 as by riveting.

It is apparent that the panel 10 may be constructed of different sizes to suit the building requirements. A typical basic dimension for the finished panel 10 is two and one-half inches thick by four feet wide by twenty five feet in length. While this is a basic dimension for the panel 10, the width and length of the panel may be varied to any size requirement. The dimensions of the panel 10 are generally selected to conform to standard construction requirements and also to minimize the number of joints and/or seams. The panel thickness is determined in part by the type of insulating material used to provide the insulating requirement. The panel thickness must be adequate to provide sufficient space for the type of insulation utilized.

Figure 3:
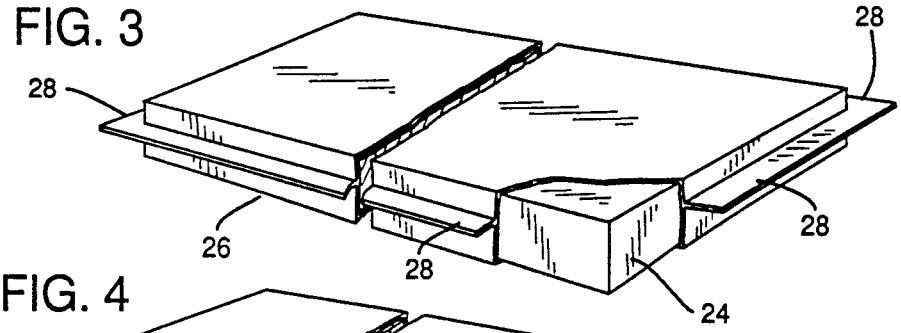
FIG. 3 is a view of insulating material encased in a container.

The insulating material 24, preferably of foil faced, rigid, high density foam material fits within the cavity 22 of the panel 10 as shown in FIGS. 1 and 2. The insulating material 24 is encapsulated in a moisture impervious container 26, preferably of a plastic material, as shown in FIG. 3. The insulating material 24 encapsulated and sealed within the container 26 may hereafter be referred to as an insulating pillow. The container 26 may be fabricated from a single plastic sheet that envelopes the insulating material 24. As shown, the plastic sheet that forms the container 26 is sufficiently large to have a border 28 on each edge of the plastic sheet extending beyond the material 24 so that the borders may be hermetically joined together to form a sealed closed container 26. The container 26 thus sealed is impervious to liquid such as water, water vapor and the like to prevent contamination of the insulating material 24. As shown, the sheet of material is of sufficient length so it may be folded once along its length near its mid point, thus having borders 28 on three sides of the insulating material that are hermetically joined together. An alternate method of producing the container 26 is the utilization of two sheets of plastic that are of sufficient width and length such that the sheets extend beyond the insulating material with borders 28 of one sheet hermetically joined to a border 28 of the other sheet that are on the same side of the insulating material. A partial vacuum may be applied prior to the final sealing of the container 26 when utilizing a rigid insulating material 24 to provide a slight pressure differential so that the container 26 will closely adhere to the periphery of the insulating material 24.

Figure 4:
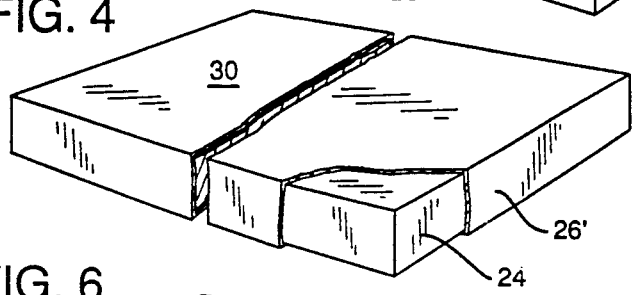
FIG. 4 is an alternate embodiment of a container for encasing the insulating material.
Figure 6:
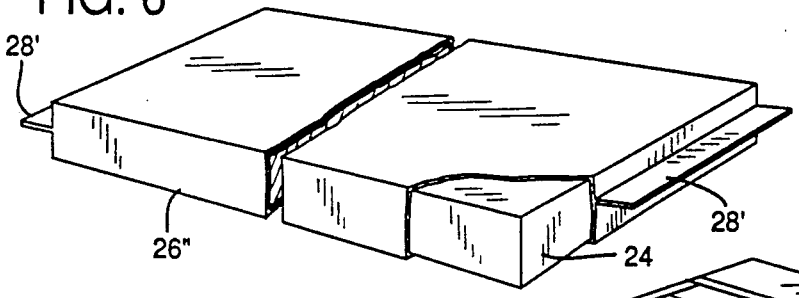
FIG. 6 is an alternate embodiment of a container for encasing the insulating material.

A container 26'' may be formed from tubular plastic material as shown in FIG. 6. The tubular material is preferably of seamless, continuous construction so that a tube of any desired length may be provided. The tubular material has a circumference that corresponds closely to the cross-sectional perimeter of the width of the insulating material 24. A length of tube is cut from the plastic material, the tube being of sufficient length so that each end of the tube has a border 28' that may hermetically sealed when a length of insulating material is slide into the tube. The insulating material is thus encapsulated and sealed in a container 26'' by merely sealing each end of the tube. The insulating material 24 may also be totally sealed by, e.g. a water impervious material 30 that is applied in liquid form to the exterior surfaces of the material 24 to form a closed container 26'. The liquid coating, such as plastic or paint, may be applied by spraying or brushing or it may be applied by dipping the insulation into a vat of coating material. When cured, the insulating material 24 is totally encased in the container 26' to form an insulating pillow as shown in FIG. 4.

Refer now to FIG. 5 which diagrammatically illustrates a kiln 32 for the drying of lumber 34. The kiln 32 has an enclosure 33 for the drying of lumber 34. The kiln 32 has an entryway 35 that is closeable by sliding doors 37, a conveyor system 36, such as a fork lift truck, for transporting lumber 34 into and out of the kiln through the entryway 35, a heating system 38 for heating air, a circulating system 40 for circulating the heated air around the lumber 34 and an exhaust system 42 for exhausting moisture laden or overtemp air when required such as when dehumidification drying is used.

The kiln 32 has a skeletal structure 44 or as may be referred to as a framework that defines the boundary of the kiln enclosure (i.e., its internal space or cavity) 33. The structure 44 is inclusive of the walls, ceiling (roof) and entry (i.e. doors) of the kiln. As shown, the panels 10 are attached to the supportive skeletal structure 44 by fastener means 50 to complete the enclosure 33 of the kiln 32. (There are a multitude of fasteners available through commercial outlets for fastening the panels 10 to the structure 44 of the kiln 32. The fastening means 50 have therefore not been detailed since the selection of the type of fastener is a matter of choice). The panels 10 attached to the structure 44 thus encloses the kiln 32 and provides the interior surface 46 (the webs 18 of one member 12 of the panel 10) of the enclosure 33, an insulating barrier for the enclosure which inhibits the transfer of heat to the exterior and the exterior surface 48 (the webs 18 of the other member 12 of the panel 10) of the kiln.

The kiln 32 depicted in this embodiment is of rectangular shape, however its design and configuration is a matter of design choice. It is apparent that the design and configuration of the kiln, including the framework will vary depending on the user's needs. A few of the variables that would be considered are for example, the roof of the kiln may be pitched, the kiln may have greater height, width and length, the entry of the kiln may be located in a different wall, different types of doors may be utilized and other conveyor means may be used to transport the lumber into and out of the kiln. The intent of the drawing is to show the panels attached to the framework of the kiln to complete the enclosure and to provide an insulating barrier for the enclosure.

While the preferred embodiments show and describe an insulating pillow installed within a cavity of a panel, the pillow may be utilized by itself to provide an insulating barrier, an inner surface and an exterior surface cf the enclosure. The pillows may for example be installed to fill the spaces between the structural framework members (e.g., studs, rafters etc.) that are utilized in conventional building construction. The pillow installed between the members provides an insulating barrier for the enclosure and the side of the pillow exposed to the interior provides the inner surface of the enclosure, and the opposite side of the pillow exposed to the exterior provides the exterior surface of the enclosure. The pillows may also be used in standard wall construction that has defined cavities between an inner wall and an outer wall.

It will be apparent to those skilled in the art that there are many variations and modifications that may be made without departing from the true spirit and scope of the invention. The panel 10 for example may be constructed from a single member rather than two as is depicted. Also the panel may have a corrugated surface on one or both of the webs for added rigidity. A single sheet of material may be folded (i.e. bent) by utilizing well known techniques in the trade such as press brakes and roll forming machines. It is also feasible to produce a "seamless" panel 10 using the technology that exits in the roll forming industry. The embodiments disclosed however permit a potential user the capability of producing the panels without the high tooling costs associated with the referenced alternate methods of production. The drying kiln of the present invention is of simple design, of low cost and easily fabricated. The insulation is provided to be impervious to the condensates present in the operating environment, and thereby maintains the insulating value of the insulation that would normally be lost due to exposure to moisture. An added advantage is the extended life of the panel due to the elimination of the corroding effect that was present in prior insulating methods due to wet insulation contacting the metal surfaces.

The scope of the invention is therefore not to be limited to the embodiments as set forth in the drawings and description but is to be determined by the appended claims.

What is claimed is:

1. A kiln for the drying of lumber products, said kiln having structural framework defining a boundary for an enclosure for receiving the lumber product to be dried, and the improvement comprising:

members of said framework in a spaced configuration defining cavities therebetween;

insulating pillows including liquid impervious containers encapsulating an insulating material and thereby forming all encompassing water impervious coverings surrounding said insulation, said insulating pillows having a designated size and shape;

said insulating pillows arranged into a configuration to fit in side-by-side relation within said cavities and thereby forming a substantially continuous wall structure surrounding said enclosure.

2. A kiln for the drying of lumber products, said kiln having structural framework defining a boundary for an enclosure for receiving the lumber product to be dried, and the improvement comprising:

individual, preformed panels of a designated size and shape, said panels each having a cavity, said panels attachable to the framework of said kiln;

means mounting said panels to said framework in side-by-size relation and thereby cooperatively providing a substantially continuous wall structure surrounding said enclosure;

an insulating material;

liquid impervious containers encapsulating said insulating material and thereby forming insulating pillows;

said insulating pillows preformed into a configuration to fit the cavities of said panels; and said insulating pillow contained in said cavities of said panels thereby providing an insulating barrier for the enclosure of said kiln.

3. A kiln for the drying of lumber products as defined in claim 2, wherein;

the encapsulating means includes a water impervious plastic material enveloping said insulating material in a manner that reduces any opportunity for moisture to contact the encapsulated insulation material.

4. A kiln for the drying of lumber products as defined in claim 3, wherein;

the encapsulating means includes a coating applied as a liquid to the exterior of said insulating material and is cured to provide a total encapsulation of the insulating material within a water impervious coating.

5. A kiln for the drying of lumber products as defined in claim 3, wherein;

the encapsulating means includes two sheets of plastic material that have overlapping edges, said edges being hermetically sealed.

6. A kiln for the drying of lumber products as defined in claim 2, wherein;

said panels have mated front and back surfaces and as attached to said framework form an internal and external surface of said dry kiln enclosure.

7. A preformed, pre-sized insulating pillow for use in cooperation with a plurality of pillows for insulating a drying kiln enclosure wherein the structure of the kiln define insulation receiving spaces, said pillow comprising;

an insulating material, a liquid impervious container, said insulating material fully encompassed and completely sealed within said container and forming thereby an individual water impervious insulating pillow, and said pillow of a size and preformed into a configuration and in cooperation with similar other preformed pillows to fit the spaces of said kiln and to thereby provide a substantially continuous wall structure to insulate the enclosure of the kiln.

8. A preformed, pre-sized insulating panel for use in cooperation with a plurality of panels for insulating a drying kiln, comprising;

a fabricated member having a cavity, an insulating material;

means encapsulating said insulating material in a liquid impervious container for forming an insulating pillow;

said insulating pillow preformed into a configuration to fit the cavity of said member;

said pillow fitting within said cavity of said member forming an insulating panel; and said panel in cooperation with similar other preformed panels being mountable to a framework of said kiln thereby providing a substantially continuous wall structure as an insulating barrier for said kiln.

9. A method of insulating a drying kiln utilized for the drying of lumber products, comprising;

providing a framework defining an enclosure, fabricating a panel having a cavity, encapsulating an insulating material in a liquid impervious container preformed into a pillow configuration to fit within the cavity of said panel, placing the fully encapsulated completely sealed pillow configuration within the cavity of the panel, and attaching said panel with similar preformed panels in side-by-side relation to said framework of said kiln thereby providing a substantially continuous wall structure as an insulating barrier for said enclosure.

* * * * *

UNITED STATES PATENT AND TRADEMARK OFFICE

CERTIFICATE OF CORRECTION

PATENT NO. : 5,138,773

DATED : August 18, 1992

INVENTOR(S) : Goodwin, et al

It is certified that error appears in the above-indentified patent and that said Letters Patent is hereby corrected as shown below:

Col. 5, line 46, change "encapsulating means" to --liquid impervious containers--.

Col. 5, line 54, change "encapsulating means" to --liquid impervious containers--.

Col. 6, line 3, change "encapsulating means" to --liquid impervious containers--.

Signed and Sealed this

Thirty-first Day of August, 1993

*Attest:*

*Attesting Officer*

Bruce Lehman

BRUCE LEHMAN

*Commissioner of Patents and Trademarks*